US007358674B2

(12) United States Patent
Bewlay et al.

(10) Patent No.: US 7,358,674 B2
(45) Date of Patent: Apr. 15, 2008

(54) STRUCTURE HAVING ELECTRODES WITH METAL CORE AND COATING

(75) Inventors: Bernard Patrick Bewlay, Schenectady, NY (US); Bruce Alan Knudsen, Amsterdam, NY (US); James Anthony Brewer, Scotia, NY (US); Melvin Robert Jackson, Corea, ME (US)

(73) Assignee: General Electric Company, Niskayuna, NY (US)

( * ) Notice: Subject to any disclaimer, the term of this patent is extended or adjusted under 35 U.S.C. 154(b) by 72 days.

(21) Appl. No.: 10/899,097

(22) Filed: Jul. 27, 2004

(65) Prior Publication Data

US 2006/0022595 A1 Feb. 2, 2006

(51) Int. Cl.
*H01J 17/02* (2006.01)

(52) U.S. Cl. ..... 313/626; 313/623

(58) Field of Classification Search ..... 313/623, 313/626

See application file for complete search history.

(56) References Cited

U.S. PATENT DOCUMENTS

| | | | | |
|---|---|---|---|---|
| 3,668,391 | A | 6/1972 | Kimball | |
| 3,753,768 | A | 8/1973 | Ichiki et al. | |
| 3,785,019 | A | 1/1974 | Chiola et al. | 29/25.13 |
| 5,161,898 | A * | 11/1992 | Drake | 384/95 |
| 5,402,038 | A | 3/1995 | Parham et al. | 313/623 |
| 6,384,533 | B1 | 5/2002 | Giesel et al. | |
| 6,414,451 | B1 * | 7/2002 | Baake et al. | 315/358 |
| 6,861,807 | B2 * | 3/2005 | Born et al. | 313/637 |
| 2002/0140351 | A1 | 10/2002 | Yamashita et al. | |
| 2003/0006705 | A1 | 1/2003 | Alderman et al. | 313/607 |
| 2004/0036415 | A1 | 2/2004 | Kai et al. | 313/626 |
| 2004/0135511 | A1 | 7/2004 | Lenz et al. | |
| 2004/0194858 | A1 * | 10/2004 | Bacos et al. | 148/240 |
| 2005/0142413 | A1 * | 6/2005 | Kimura et al. | 429/34 |

FOREIGN PATENT DOCUMENTS

| | | | |
|---|---|---|---|
| EP | 0926106 | A | 6/1999 |
| GB | 459922 | A | 1/1937 |
| JP | 58064748 | A | 4/1983 |
| RU | 2164965 | C2 | 4/2001 |

OTHER PUBLICATIONS

PCT Search Report, PCT/US2005/026019, May 12, 2006.

* cited by examiner

*Primary Examiner*—Joseph Williams
*Assistant Examiner*—Bumsuk Won
(74) *Attorney, Agent, or Firm*—Jason K. Klindtworth; Curtis B. Brueske

(57) ABSTRACT

A conductive element comprises a metal core and a coating, wherein the coating comprises at least one layer of aluminum, an aluminum alloy, an aluminide, silicon, a silicon alloy, a silicide, and combinations thereof, and wherein the at least one layer has a predetermined thickness. A method of making a conductive element comprises depositing a coating material on a metal core to form a coated metal core and heating the coated metal core to a predetermined temperature to form at least one layer of aluminum, an aluminum alloy, an aluminide, silicon, a silicon alloy, a silicide, and combinations thereof.

26 Claims, 2 Drawing Sheets

STRUCTURE HAVING ELECTRODES WITH METAL CORE AND COATING

BACKGROUND OF THE INVENTION

The invention relates to a conductive element and a method of making the conductive element. In particular, the invention relates to a conductive feedthrough for use in discharge lamps and a method of coating the conductive feedthrough.

Usually, discharge lamps consist of an outer envelope made of ceramic that encompasses an inner enclosure known as sealed envelope or "arc tube". The sealed envelope is usually made of quartz, yttrium aluminum garnet, ytterbium aluminum garnet, micro grain polycrystalline alumina, polycrystalline alumina, sapphire, and yttria. The alumina or yttria based sealed envelope employs pure niobium or a niobium alloy as a conductive feedthrough material since niobium has a coefficient of thermal expansion compatible to that of yttria and alumina based ceramics. At high temperatures niobium has a very poor chemical resistance to oxygen and nitrogen, and the resistance substantially decreases as the temperature increases. As a result, the sealed envelope cannot be operated in air and has to be operated in a protective environment, which is typically a vacuum, or inert gas. Protective environment is provided by maintaining a vacuum or providing an inert gas in the space available between the outer envelope and the sealed envelope. The use of the outer envelope decreases the optical efficiency of the lamp. Further, the use of the outer envelope results in the size of the lamp being larger, and also adds to the cost of the lamp.

Accordingly, there exists a need to produce a conductive feedthrough having oxidation resistance and nitride formation resistance. What is also needed is a conductive feedthrough that can operate effectively in air at high temperature.

SUMMARY OF THE INVENTION

A first aspect of the invention provides a conductive element comprising a metal core and a coating, wherein the coating comprises at least one layer of aluminum, an aluminum alloy, an aluminide, silicon, a silicon alloy, a silicide, and combinations thereof, and wherein the at least one layer has a predetermined thickness.

A second aspect of the invention provides a structure comprising a transparent or translucent sealed envelope; at least two electrode tips disposed within the sealed envelope; and at least two conductive feedthroughs coupled to the at least two electrode tips, comprising a metal core and a coating, wherein the coating comprises at least one layer of aluminum, an aluminum alloy, an aluminide, silicon, a silicon alloy, a silicide, and combinations thereof, and wherein the at least one layer has a predetermined thickness.

A third aspect of the invention provides a method for making a conductive element, the method comprising: providing a metal core; providing a coating material comprising at least one of aluminum and silicon, and combinations thereof; depositing the coating material on the metal core; and heating the metal core to a predetermined temperature in an inert atmosphere to form at least one layer of aluminum, an aluminum alloy, an aluminide, silicon, a silicon alloy, a silicide, and combinations thereof.

A fourth aspect of the invention provides a method of making a conductive feedthrough for a lamp, the method comprising: providing a niobium alloy core; providing at least one precursor of a coating material in a slurry; depositing the slurry on the niobium alloy core such that the niobium alloy core is covered by the slurry; and heating the niobium alloy core covered by the slurry at a predetermined temperature in an inert atmosphere for a predetermined period of time to form a coating on the niobium alloy core.

A fifth aspect of the invention provides a device, or an article of manufacture, having at least one component comprising a conductive element of the first aspect.

These and other aspects, advantages, and salient features of the present invention will become apparent from the following detailed description, the accompanying drawings, and the appended claims.

DETAILED DESCRIPTION OF THE INVENTION

Figure 1:
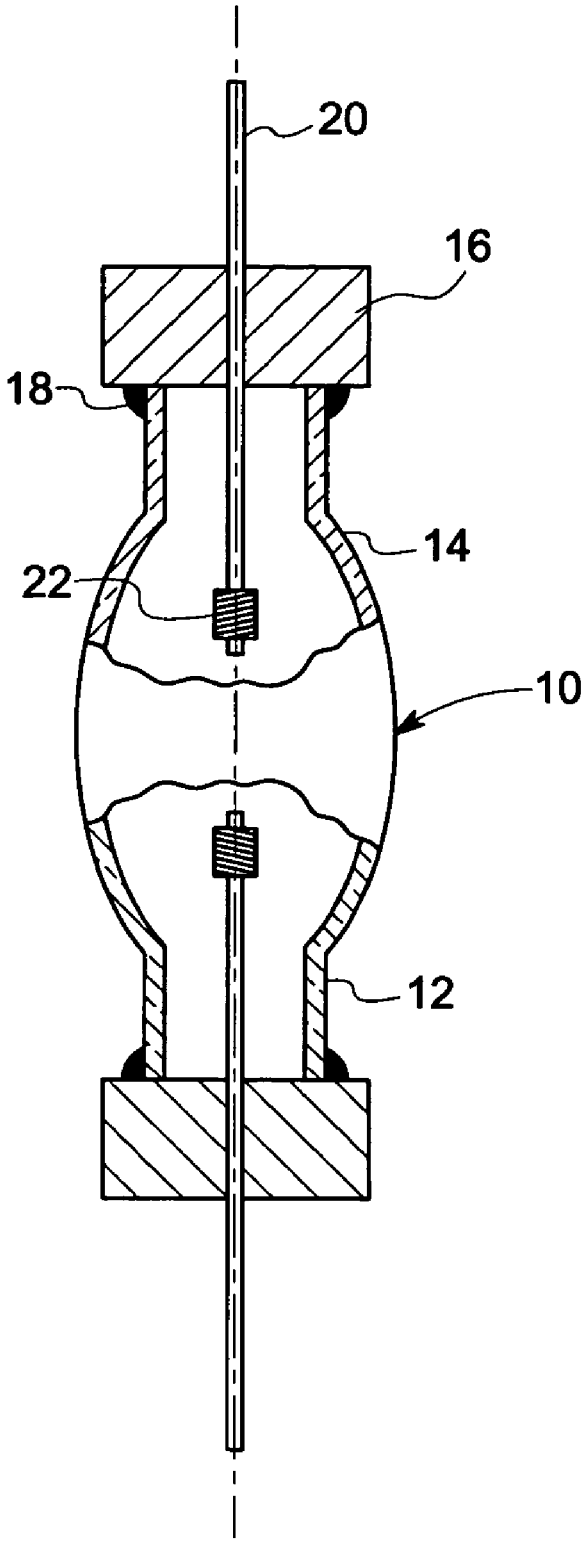
FIG. 1 is a diagrammatic overview of an exemplary sealed envelope.

Referring to the drawings in general, it will be understood that they are to illustrate and facilitate understanding of the embodiments of the invention, and are not intended as limitations thereto. In the following description, like reference characters designate like or corresponding parts throughout the several views shown in the figures.

As discussed in detail below, the present invention comprises a conductive element comprising a metal core and a coating. The coating comprises at least one layer of aluminum, an aluminum alloy, an aluminide, silicon, a silicon alloy, a silicide, and combinations thereof, and wherein the at least one layer has a predetermined thickness.

In one embodiment, the conductive element is employed in a discharge lamp. As described herein, the conductive element of the present invention employed in the lamp is referred to as a conductive feedthrough. In one embodiment, the lamp is a high intensity discharge (HID) lamp. In another embodiment, the lamp is a ceramic metal halide (CMH) lamp. In yet another embodiment, the lamp is a high-pressure sodium (HPS) lamp. In yet another embodiment, the lamp is an automotive lamp.

FIG. 1 is a diagrammatic overview of an exemplary sealed envelope 10 for use in a discharge lamp. The sealed envelope 10 employed in the discharge lamp may be transparent or translucent. Typically, the sealed envelope 10 is made of a ceramic material, such as, but not limited to, quartz, polycrystalline alumina, micro grain polycrystalline alumina, yttrium aluminum garnet, ytterbium aluminum garnet, sapphire, and yttria. The sealed envelope 10 is sealed at the lower end 12 and the upper end 14 by two end caps 16. The end caps 16 are bonded to the sealed envelope 10 by means of a sealing composition 18. Sealed envelope 10 also has a conductive feedthrough 20 extending out of each end cap 16. Niobium has a coefficient of thermal expansion close to that of alumina and hence in case of alumina based sealed envelopes, niobium is generally a preferred metal for the feedthrough 20. Both the conductive feedthroughs 20 extend through the end caps 16 and terminate at the electrode tip 22. The electrode tip 22 is usually made of metals, such as, but not limited to, molybdenum, and tungsten.

The sealed envelope 10 further comprises an optically active dosing substance disposed within the sealed envelope 10. The dosing substance also known as a "fill material" emits a desired spectral energy distribution in response to being excited by an electrical discharge across the electrodes. Dosing substance may comprise a luminous gas, such as rare gas and mercury. The dosing substance may also include a halide (e.g., bromine, iodine, etc.), a rare earth metal halide, and so forth.

Typically, the operating temperature of the sealed envelope 10 varies from about 650° C. to about 1500° C. At such high temperatures, the conductive feedthrough 20 also heats up to temperatures of about 200° C. and higher, and is susceptible to chemical reactions with oxygen and nitrogen. Chemical reaction of the conductive feedthrough 20 with oxygen, or oxidation of the conductive feedthrough 20 results in increased resistivity of the conductive feedthrough 20, which in turn leads to decrease in the amount of current supplied to the electrode, and hence negatively affects the performance of the lamp. Moreover, the conductive feedthrough 20 expands as a result of oxidation and leads to cracking of the sealed envelope 10. Chemical reaction of the conductive feedthrough 20 with nitrogen on the other hand, leads to nitride formation on the surface of the conductive feedthrough 20, which makes the conductive feedthrough 20 brittle. Also, nitrogen seeps from the surface of the conductive feedthrough 20 into the core and results in nitride formation inside the conductive feedthrough 20, making the conductive feedthrough 20 brittle. To avoid this, usually, an outer envelope made of quartz is used to cover the sealed envelope 10 and provide a protective environment, such as vacuum or inert gas, which prevents the degradation of the conductive feedthrough due to oxide or nitride formation. However, the use of the outer envelope leads to an increase in the size of the lamp and, also, adds to the cost of lamp.

In one aspect of the present invention, the conductive feedthrough 20 comprises a metal core and a coating, wherein the coating has at least one layer of aluminum, an aluminum alloy, an aluminide, silicon, a silicon alloy, a silicide, and combinations thereof, and wherein the at least one layer has a predetermined thickness. The purpose of the coating is to protect the metal core from chemically reacting with oxygen and nitrogen in air at temperatures varying in a range from about 200° C. to about 1100° C. This makes it possible to use the sealed envelope directly in the ambient atmosphere without using any outer envelope for the sealed envelope 10. In addition to nitrogen and oxygen, the coating is also found to be resistant to carbon. In one embodiment, a sealed envelope 10 employing the conductive feedthrough 20 having a metal core and a coating is exposed to air while in operation.

Figure 2:
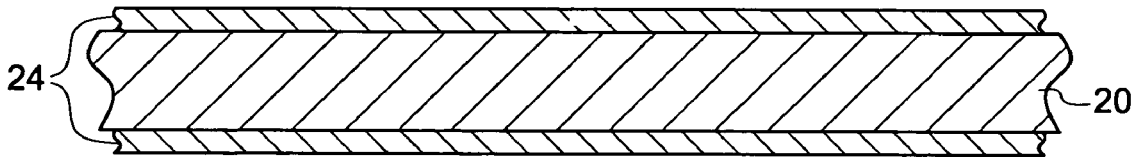
FIG. 2 is a schematic illustration of the conductive feedthrough with one layer of the coating.
Figure 3:
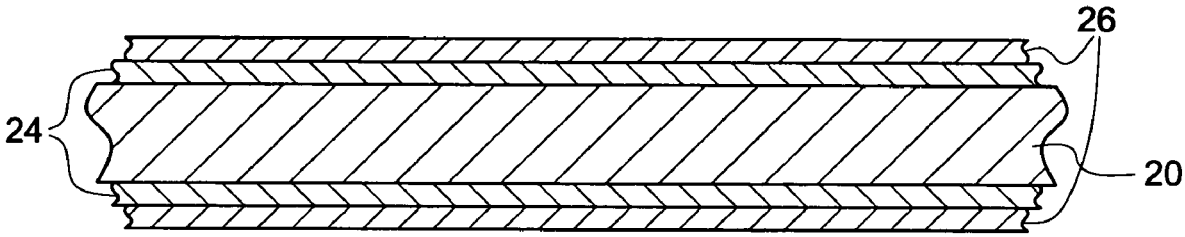
FIG. 3 is a schematic illustration of the conductive feedthrough with two layers of the coating.

FIG. 2 is a schematic illustration of the conductive feedthrough 20 comprising a coating 24. Likewise, FIG. 3 is a schematic illustration of the conductive feedthrough 20 employing a first layer 24 and a second layer 26. In one embodiment, the predetermined thickness is in a range from about 5 micrometers to about 500 micrometers. In one embodiment, the predetermined thickness is in a range from about 30 micrometers to about 300 micrometers. In another specific embodiment, the predetermined thickness is in a range from about 50 micrometers to about 150 micrometers.

In one embodiment, the coating comprises aluminides of metals, such as, chromium, titanium, niobium, zirconium, hafnium, iron, tin, yttrium, combinations thereof, and alloys thereof. In one embodiment, the aluminide comprises a titanium aluminide. In another specific embodiment, the aluminide comprises a niobium aluminide.

In another embodiment, the coating comprises silicides, such as, aluminum, chromium, titanium, germanium, niobium, iron, hafnium, zirconium, combinations thereof, and alloys thereof. In one embodiment, the silicide comprises a niobium-chromium-iron silicide. In another embodiment, the silicide comprises a niobium-chromium-titanium-iron silicide.

In one aspect of the present invention, a method of making a conductive element is provided. The conductive element comprises a metal core and a coating. The metal core comprises niobium, tungsten, molybdenum, combinations thereof, and alloys thereof. The coating comprises at least one layer of aluminum, an aluminum alloy, an aluminide, silicon, a silicon alloy, a silicide, and combinations thereof. The coating material employed to make the coating comprises at least one of aluminum, and silicon, and combinations thereof. In one embodiment, the coating material further comprises at least one of chromium, titanium, germanium, niobium, iron, tin, yttrium, and combinations thereof, and alloys thereof.

In one embodiment, the metal core is coated using methods such as, but not limited to, chemical vapor deposition, physical vapor deposition, slurry coating, spray coating, pack cementation, and combinations thereof. The coated metal core is subjected to heating in an inert atmosphere to form the conductive element comprising a metal core and a coating comprising at least one layer of aluminum, an aluminum alloy, an aluminide, silicon, a silicon alloy, a silicide and combinations thereof.

In one embodiment, a method is provided for making a conductive feedthrough 20 for a lamp, wherein the conductive feedthrough 20 comprises a niobium alloy core. The method used for coating the niobium alloy core comprises a slurry coating method. The precursor of the coating may comprise elemental powders of the precursors or alloy powders of the precursors. In one embodiment, the precursor of the coating comprises elemental powders of at least one of aluminum, niobium, silicon, titanium, iron, germanium, yttrium, and chromium. In another embodiment, the precursor of the coating comprises at least one alloy precursor, wherein the alloy precursor comprises powders such as, aluminum, chromium, silicon, titanium, germanium, niobium, iron, tin, yttrium, combinations thereof, alloys thereof. The precursor of the coating material is mixed with a suitable medium to form a slurry. The medium comprises at least one of, acid, alcohol, water and combinations thereof. In one embodiment, the medium comprises chromic acid. In another specific embodiment, the medium comprises phosphoric acid. In yet another embodiment, the medium comprises water. The precursor of the coating and the medium are mixed in various proportions. In one embodiment, the proportion of water, and the precursor of the coating are 1:1.

In one embodiment, the slurry comprises 30 atomic percent niobium, 40 atomic percent aluminum, and 30 atomic percent chromium mixed in a solution having 2.5 weight percent of chromic acid, 15 weight percent of phosphoric acid, and balance water. In another embodiment, the slurry comprises 20 atomic percent niobium, 40 atomic percent aluminum, 20 atomic percent silicon, and 20 atomic percent chromium mixed in a solution having 2.5 weight percent of chromic acid, 15 weight percent of phosphoric acid, and balance water. In yet another embodiment, the slurry comprises 20 atomic percent niobium, 40 atomic percent aluminum, 10 atomic percent silicon, 10 atomic percent germanium, and 20 atomic percent chromium mixed in a solution having 2.5 weight percent of chromic acid, 15 weight percent of phosphoric acid, and balance water. In still another embodiment, the slurry comprises 10 atomic percent niobium, 10 atomic percent titanium, 40 atomic percent aluminum, 10 atomic percent silicon, 10 atomic percent germanium, and 20 atomic percent chromium mixed in a solution having 2.5 weight percent of chromic acid, 15 weight percent of phosphoric acid, and balance water. In still another embodiment, the slurry comprises 10 atomic percent niobium, 8 atomic percent titanium, 38 atomic percent aluminum, 10 atomic percent silicon, 8 atomic percent germanium, 20 atomic percent chromium, 4 atomic percent iron, 2 atomic percent tin, and 0.2 atomic percent yttrium, and balance niobium aluminide mixed in a solution having 2.5 weight percent of chromic acid, 15 weight percent of phosphoric acid, and balance water. In still another embodiment, the slurry comprises 10 atomic percent niobium, 8 atomic percent titanium, 38 atomic percent aluminum, 10 atomic percent silicon, 8 atomic percent germanium, 20 atomic percent chromium, 4 atomic percent iron, 1.8 atomic percent tin, and 0.2 atomic percent yttrium, and balance niobium aluminide mixed in a solution having 2.5 weight percent of chromic acid, 15 weight percent of phosphoric acid, and balance water.

The niobium alloy core is immersed in the slurry for a predetermined period of time to deposit the slurry on the niobium alloy core. In one embodiment, the predetermined time is in a range from about 30 seconds to about 2 hours. In another embodiment, the predetermined time is in a range from about 30 seconds to about 30 minutes.

In one embodiment, a binder, such as magnesium oxide, is added to the slurry. On heating the niobium alloy core coated with the slurry, the binder forms a matrix and thereby, facilitates bonding of the coating to the niobium alloy core.

In one embodiment, the niobium alloy coated with slurry is subjected to curing for a definite time period to remove water. The niobium alloy core is subjected to curing at temperatures in a range from about 25° C. to about 500° C. for a time varying in a range from about 30 minutes to about 5 hours in air. In one embodiment, the niobium alloy core is subjected to curing for about 1 hour at temperatures in a range from about 25° C. to about 200° C. in air. In one embodiment, the curing of the niobium alloy core is done in a convective oven.

The niobium alloy core covered with slurry is heated in an inert atmosphere at a predetermined temperature for a predetermined period of time. In one embodiment, prior to heating, the niobium alloy core is subjected to curing, following curing, the niobium alloy core is heated further in an inert atmosphere at a different predetermined temperature for a predetermined period of time. In one embodiment, the heating is done by means such as, but not limited to a vacuum heating furnace. In another embodiment, the niobium alloy core coated with slurry is subjected to a temperature in a range from about 100° C. to about 1500° C. The predetermined period of time is in a range from about 30 minutes to about 5 hours. In another embodiment, the predetermined period of time is in a range from about 1 hour to about 3 hours.

In one embodiment, the inert atmosphere comprises argon, helium, neon, krypton, xenon, and combinations thereof. The niobium alloy core is cooled to room temperature under the same atmosphere.

In one embodiment, an article of manufacture comprises the conductive element of the present invention. Further, the article of manufacture is selected from a group consisting of electrical devices such as, lamps, electric motors, sensors, and thermocouples.

The following example illustrates certain features of the invention, and is not intended to limit the invention in any way.

EXAMPLE 1

A coating comprising 30 atomic percent niobium, 40 atomic percent aluminum, 30 atomic percent chromium was prepared. A 100 grams mixture of the precursor of the coating was prepared by taking elemental powders of niobium, aluminum, and chromium. A 51.4 grams charge of niobium powder with an average particle size of less than 20 micrometers obtained from Cerac, 19.9 grams aluminum powder with an particle size ranging between 5 to 15 micrometers obtained from Alfa Aesar (Parkridge Road, Ward Hill, Mass.), and 28.7 grams chromium powder with an average particle size of less than 5 micrometers obtained from Alfa Aesar (Parkridge Road, Ward Hill, Mass.) were mixed in a pestle and mortar. Water and ethanol was used as a medium. The mixture was then made into a slurry by subjecting to milling in a tumbling mill.

A niobium alloy core obtained from Cabot Corporation was dipped in the slurry for about 10 minutes. The niobium alloy core coated with the slurry was then cured at a temperature of about 150° C. for a period of about 2 hours in a convective oven. The niobium alloy core coated with the slurry was then heated in a furnace at a temperature of about 1000° C. for 2 hours in an inert atmosphere of argon to form the coating comprising a layer of niobium-chromium aluminide. The niobium core with the coating was then cooled to ambient temperature under the same atmosphere to obtain a conductive feedthrough 20.

EXAMPLE 2

A coating comprising 14.2 atomic percent titanium, 13.1 atomic percent chromium, 72.7 atomic percent silicon. A 50 grams mixture of the precursor of the coating was prepared by taking elemental powders of titanium, chromium, and silicon. A 10 grams charge of titanium powder with an average particle size of about 25 micrometers obtained from Alfa Aesar (Parkridge Road, Ward Hill, Mass.), 10 grams chromium powder with an particle size less than 10 micrometers obtained from Alfa Aesar (Parkridge Road, Ward Hill, Mass.), and 30 grams silicon powder with an average particle size ranging from about 1 micrometer to about 20 micrometers obtained from Alfa Aesar (Parkridge Road, Ward Hill, Mass.) were mixed in a pestle and mortar. Water and ethanol was used as a medium. The mixture was then made into a slurry by subjecting to milling in a tumbling mill.

A niobium alloy core obtained from Cabot Corporation was dipped in the slurry for about 10 minutes. The niobium alloy core coated with the slurry was then heated at a temperature of about 1300° C. for a period of about 2 hours in an inert atmosphere of argon. As a result of heating, the metal powders melt and react with the niobium alloy core to form a coating comprising a layer of titanium-chromium-niobium silicide. The niobium core with the coating was then cooled to ambient temperature to obtain a conductive feedthrough 20.

While various embodiments are described herein, it will be appreciated from the specification that various combinations of elements, variations, equivalents, or improvements therein may be made by those skilled in the art, and are still within the scope of the invention as defined in the appended claims.

What is claimed is:

1. A structure comprising:

a sealed envelope that is transparent or translucent;

at least two electrode tips disposed within the sealed envelope, each comprising a first material; and at least two conductive feedthroughs having respective portions extending outside of the sealed envelope, each of which is coupled to one of the at least two electrode tips and comprises a metal core and a coating, wherein the coating comprises at least one layer of a second material selected from the group consisting of aluminum, an aluminum alloy, an aluminide, silicon, a silicon alloy, a silicide, and combinations thereof, and wherein the first material is different from the second material; and wherein the coating is coated on the respective portions which extend outside the sealed envelope to protects the metal core from ambient atmosphere.

2. The structure according to claim 1, wherein the sealed envelope comprises a material selected from the group consisting of quartz, polycrystalline alumina, micro grain polycrystalline alumina, yttria, yttrium aluminum garnet, and ytterbium aluminum garnet.

3. The structure according to claim 1, wherein the at least two electrode tips comprises molybdenum.

4. The structure according to claim 1, wherein the at least two electrode tips comprises tungsten.

5. The structure according to claim 1 further comprising a dosing substance disposed within the sealed envelope.

6. The structure according to claim 5, wherein the dosing substance comprises a luminous gas.

7. The structure according to claim 1, wherein the metal core comprises a metal selected from the group consisting of niobium, tungsten, molybdenum, combinations thereof, and alloys thereof.

8. The structure according to claim 1, wherein the aluminide comprises an aluininide of at least one of chromium, titanium, niobium, zirconium, hafnium, iron, tin, yttrium, combinations thereof, and alloys thereof.

9. The structure according to claim 8, wherein the aluminide is a titanium aluminide.

10. The structure according to claim 8, wherein the aluminide is a niobium aluininide.

11. The structure according to claim 1, wherein the aluminide layer has been formed from a layer of an aluminum coating on the metal core.

12. The structure according to claim 1, wherein the aluininide layer has been formed from a layer of an aluminum alloy coating on the metal core.

13. The structure according to claim 1, wherein the silicide comprises a silicide of at least one of aluminum, chromium, titanium, germanium, niobium, iron, hafnium, zirconium, combinations thereof, and alloys thereof.

14. The structure according to claim 13, wherein the silicide is niobium-chromium-titanium silicide.

15. The structure according to claim 13, wherein the silicide is niobium-chromium-titanium-iron silicide.

16. The structure according to claim 1, wherein the silicide layer has been formed from a layer of a silicon coating on the metal core.

17. The structure according to claim 1, wherein the silicide layer has been formed from a layer of a silicon alloy coating on the metal core.

18. The structure according to claim 1, wherein the predetermined thickness of the at least one layer is about 5 micrometers to about 500 micrometers.

19. The structure according to claim 18, wherein the predetermined thickness of the at least one layer is about 30 micrometers to about 300 micrometers.

20. The structure according to claim 19, wherein the predetermined thickness of the at least one layer is about 50 micrometers to about 150 micrometers.

21. The structure according to claim 1, wherein the structure is a high intensity discharge lamp.

22. The structure according to claim 1, wherein the structure is a ceramic metal halide lamp.

23. The structure according to claim 1, wherein the structure is a high-pressure sodium lamp.

24. The structure according to claim 1, wherein the structure is an automotive lamp.

25. The structure according to claim 1, wherein the sealed envelope and the conductive feedthroughs are exposed to air.

26. A device comprising:

a sealed envelope that is transparent or translucent;

at least two electrode tips disposed within the sealed envelope, wherein the at least two electrode tips comprises a material selected from the group consisting of tungsten, molybdenum, and combinations or alloys thereof; and at least two conductive feedthroughs having respective portions extending outside of the sealed envelope, each of which is coupled to one of the at least two electrode tips and comprises a metal core and a coating, wherein the coating comprises at least one layer of a material selected from the group consisting of aluminum, an aluminum alloy, an aluminide, silicon, a silicon alloy, a silicide, and combinations thereof, and wherein the coating is coated on the respective portions which extend outside the sealed envelope to protect the metal core from chemically reacting with one or more of oxygen, carbon or nitrogen.

* * * * *